United States Patent [19]

Mathews

[11] Patent Number: 4,559,653

[45] Date of Patent: Dec. 24, 1985

[54] ROTATABLE HYDROTHERAPY NOZZLE

[75] Inventor: Lester R. Mathews, Phoenix, Ariz.

[73] Assignee: Caretaker Systems, Inc., Scottsdale, Ariz.

[21] Appl. No.: 468,174

[22] Filed: Feb. 25, 1983

Related U.S. Application Data

[63] Continuation-in-part of Ser. No. 438,978, Nov. 3, 1982, which is a continuation-in-part of Ser. No. 359,442, Mar. 18, 1982.

[51] Int. Cl.[4] ..... E03C 1/02; A61H 33/02

[52] U.S. Cl. ..... 4/541; 4/542; 4/490; 4/492; 239/206; 239/240

[58] Field of Search ..... 4/492, 541, 542, 490, 4/496; 128/66; 137/119; 239/206, 240

[56] References Cited

U.S. PATENT DOCUMENTS 4,339,833 7/1982 Mandell ..... 4/492 X 4,358,862 11/1982 Altman et al. ..... 4/492 X

*Primary Examiner*—Henry K. Artis

*Attorney, Agent, or Firm*—LaValle D. Ptak

[57] ABSTRACT

A replaceable rotatable therapy head is disclosed wherein the operating mechanism including an impeller and a gear train between the impeller and a ring gear on the housing is supported by a ring which is integral with the emitting nozzle and the supporting ring is held to the body of the structure by means of the flange ring also bonded to the body of the therapy head. The gear train is at the downstream end of the housing and the impeller blades are at the upstream end of the housing spaced from the gear train. A water diversion means is disposed between the gear train and the impeller blades. A friction reducing ring or the like is disposed between the support ring and the housing. The system utilizing the heads, which may be at a selected acute angle, includes aerators in the supply lines for mixing the water with air.

6 Claims, 12 Drawing Figures

ROTATABLE HYDROTHERAPY NOZZLE

This application is a continuation-in-part of application Ser. No. 438,978, filed on Nov. 3, 1982 with improved flow characteristics in the name of Lester R. Mathews for Improved Rotatable Hydrotherapy Nozzle, which application is a continuation-in-part of application Ser. No. 359,442, filed on Mar. 18, 1982 in the name of the same applicant for Rotatable Therapy Device.

BACKGROUND OF THE INVENTION

This invention relates to hydrotherapy heads or nozzles for spas and the like and systems thereof, more particularly to a replaceable rotatably hydrotherapy head or nozzle and systems thereof, and it is an object of the invention to provide an improved device and system of this nature.

Spas for health as well as enjoyment purposes are well-known and are becoming ever more popular. Such spas involve, briefly, a tank or container at the surface of the ground or floor into which water of varying temperatures mixed with air is pumped at relatively high pressure for impingement on the bodies of the people using the spa. The aerated water jets from openings in nozzles disposed in the floor and wall of the spa in the past have had a fixed orientation, and have been relatively difficult to replace when servicing is needed. A hydrotherapy nozzle in accordance with the invention is rotatable and thus provides a jet or stream of aerated water impinging on the bodies of users irrespective of location in the spa and the head is provided with threads for easy attachment to a spa wall so that whenever any existing head is to be replaced, it is a very simple matter to remove it and replace it with one according to the invention. The rotatable feature of the nozzle is provided by gear mechanism attached to the nozzle support itself so that no further separate mechanism is needed.

Rotatable valves wherein the rotation is achieved by water flowing through the valve and impinging upon an impeller which through an appropriate gear train drives the valve are known, as for example, in the Henry D. Gould U.S. Pat. No. 3,779,269. In addition to the size of valves of the Gould patent, the operating mechanism thereof is carried by the support structure. Hence Gould does not present the problems of manufacture involved in small therapy heads of the type forming the subject matter of this application. According to the invention the impeller and the connected gear train are supported by the rotating nozzle portion itself.

Hydrotherapeutic spa systems are also well known and include mechanisms for the entrainment of air in the circulating water. Reference, in this respect, may be made to U.S. Pat. No. 3,159,849, Jacuzzi, U.S. Pat. No. 3,943,580 Carter, and the U.S. Pat. to Neenan No. 4,320,541.

SUMMARY OF THE INVENTION

It is a further object of the invention to provide an improved rotatable hydrotherapy head and system thereof which overcomes the defects of the prior art.

It is a still further object of the invention to provide an improved rotatable hydrotherapy head and system thereof that is simple in form, easy to construct, and efficient in operation.

It is a still further object of the invention to provide an improved rotatable hydrotherapy head of the nature indicated which is simple and easy to replace when service is needed.

It is a still further object of the invention to provide an improved hydrotherapy head of the nature indicated having improved flow characteristics and reduced fluid pressure drop therethrough.

It is an additional and further object to provide an improved hydrotherapy head of the nature indicated that shields gears from the fluid flow path.

In carrying out the invention according to one form there is provided a replaceable rotatable hydrotherapy head, or nozzle for spas and the like comprising, a housing having an inlet end and an outlet end through which water is adapted to flow, a nozzle member including a base rotatably mounted in the housing, an impeller supported on the base and adapted to rotate under the influence of water flowing from the inlet through the outlet, and mechanism supported by the base and driven by the impeller for rotating the nozzle.

In carrying out the invention according to another form there is provided a rotatable hydrotherapy head or nozzle comprising a housing having an inlet end and an outlet end through which water is adapted to flow, a support ring having an opening therethrough disposed at the outlet end of the body, an annular flanged ring attached to the outlet end of the body and rotatably holding the support ring at its periphery to the body, an impeller including a gear member adapted to be rotated by water flowing through the inlet end of the body mounted on the support ring, a ring gear on the interior of the housing adjacent the outlet end of the housing, a gear train operatively between and engaging the gear member and the ring gear mounted on the support member, and a nozzle member mounted in the support ring opposite to the impeller, said nozzle member having a water jet opening at a selected angle.

In carrying out the invention according to a still further form there is provided a hydrotherapeutic system including in combination: a container for fluid having a size sufficient to permit at least partial submersion of a person therein; a plurality of hydrotherapy heads in said container located beneath the normal fluid level thereof for supplying streams of fluid under pressure at an acute angle to the surface of the container at the location of each of said heads; and means for simultaneously and continuously rotating the streams of fluid issuing from said heads to create a varying pattern of fluid movement in said container.

The rotating nozzles at an angle create a rolling water motion for massaging, so to speak, the body of the user.

Improved flow characteristics and decreased fluid pressure drop through the head are achieved by an angular shield or baffle directing fluid flow away from the gear train thereby preventing turbulence, a shroud of increased length surrounding and spacing the impeller a greater distance away from the gear train.

BRIEF DESCRIPTION OF THE DRAWINGS

For a better understanding of the invention, reference may now be had to the drawings in which.

DESCRIPTION OF THE PREFERRED EMBODIMENTS

Figure 1:
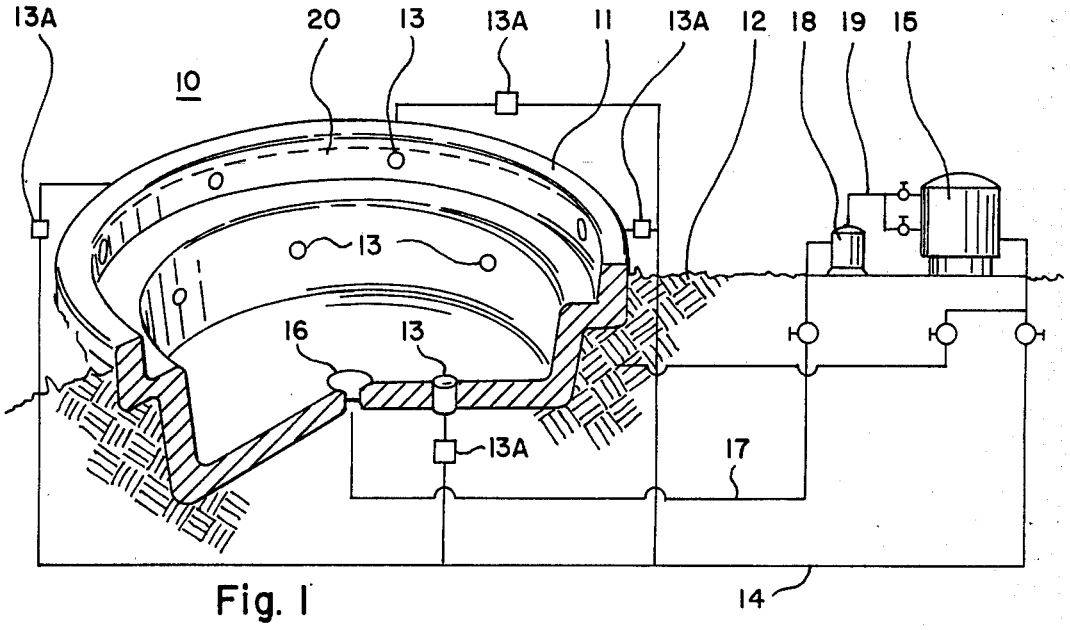
FIG. 1 is a diagrammatic view in perspective illustrating a spa utilizing the therapy head according to the invention.

Referring to the drawings there is shown in FIG. 1 a spa 10 which may comprise any suitable container or tank 11 disposed on the ground or surface 12 and having a series of nozzles or therapy heads 13 disposed in its surface at various points. The heads may be referred to as hydrotherapy heads. Each of the heads 13 is connected through one or more conduits 14 to the output of a well-known filter 15. In each of the lines 14 leading to a head 13 there is an aerating device 13A which may be of any well-known form, for example, as shown in the Jacuzzi or Carter patents. Water collected from a drain 16 in the bottom of the spa is fed through a drain pipe or conduit 17 to a pump 18. From the output of the pump water is forced through a pipe or conduit 19 to the filter 15 and thence through the conduits 14 to the ejecting nozzles or therapy heads 13 through the aerating devices 13A as is well understood. The conduit, filter and pumping arrangement etc. shown in FIG. 1 is by way of example only and does not form any portion of the invention of the subject application. The water and air issuing from nozzles 13, of course, is under such pressure as is desired.

Therapy heads known to the prior art were fixed in nature and whatever direction the emitting jet of water had it would retain and always be the same. In addition prior art heads were difficult to remove and replace whenever servicing was needed.

Figure 2:
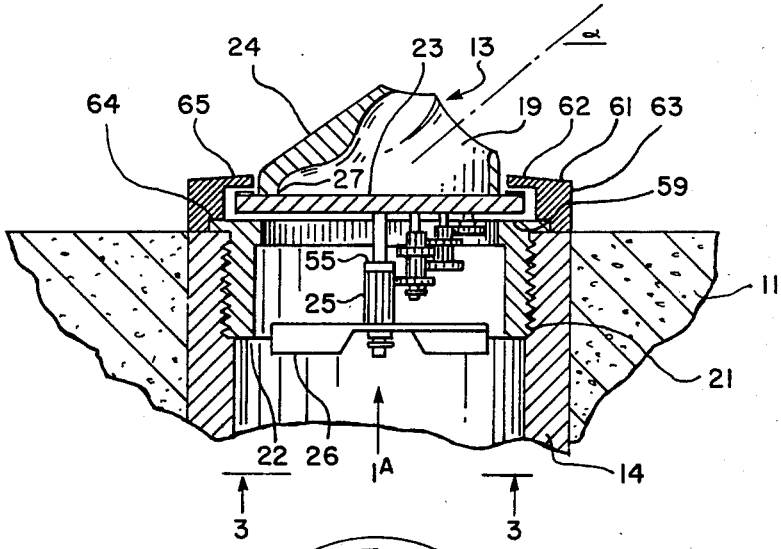
FIG. 2 is a sectional view on a larger scale of a rotatable therapy head according to the invention.
Figure 3:
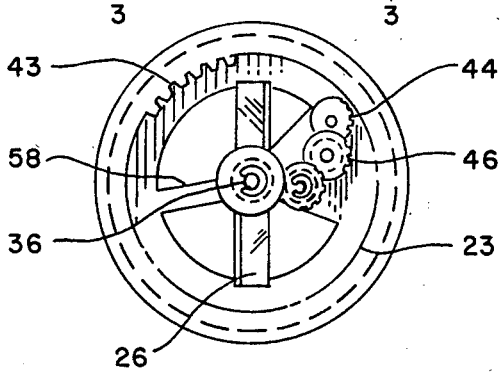
FIG. 3 is a view taken substantially in the direction of arrows 3—3 of FIG. 2.

In the sectional view of FIG. 2 the conduit 14 is shown imbedded in or passing through the body of the spa 11 and the hydrotherapy head 13 is shown held in the conduit 14 by virtue of the threaded connection 21.

The therapy head 13 comprises a body 22, a support ring 23, a domed-shaped nozzle 24, a gear train 25 supported on the ring 23 and an impeller 26 also supported from the ring 23. The jet or nozzle opening 19 is enlarged and disposed at an angle to the nozzle axis as may be visualized in FIG. 2 in order that a substantial stream of water may emit therefrom to contact the bodies of the persons using the spa. The object is to obtain a substantial flow of water as compared with having a small relatively high pressure jet. The larger stream of water massages the body of the user. Any angle of the nozzle opening 19 may be selected and more than one nozzle opening may be provided, as desired. The nozzle opening is shown in FIG. 2 the acute angle alpha. A varying pattern of water and air movement is created.

The water level in the spa 10 may be as desired but typically may be above the highest row of nozzles as shown by the broken line 20.

The domed nozzle 24 may be a molded part and attached to the support ring 23 at the juncture 27 which forms a ring as may be visualized. The joint or juncture 27 may be achieved by sonic welding or by some suitable adhesive, as is well understood, so that the dome nozzle 24 and the support ring 23 form a unitary part. Projecting bosses 28, 29, 31 and 32 (FIG. 4) may be formed on the undersurface of the supporting ring 23 for receiving shafts 33, 34, 35 and 36, respectively, to support gears, as will be described. The bosses may be eliminated, if desired and the shaft supported in the material of the ring itself if sufficient strength is thereby available. There are openings, of course, in the various bosses in order to support the shafts shown or dispositioned therein.

The shaft 36 is received in the opening in boss 32 and disposed on the shaft is a main gear 37 whose lower end 38 will be cemented to the upper surface 39 of the impeller 26 so that the gear 37 and the impeller 26 form a unitary piece. The impeller 26 has a pair of oppositely disposed angularly formed vanes 41 and 42 so that when water impinges there against in flowing through the head, as shown by the arrow A (FIG. 2), the impeller 26 rotates thereby causing the gear 37 to rotate.

Interiorly of the cylindrical body or housing 22 is a ring gear 43 which meshes with a spur gear 44 supported on shaft 33 received in the opening in boss 28. Meshing with gear 44 is a gear 45 attached to gear 46 as a unit and supported on shaft 34 received in the opening in boss 29.

Figure 4:
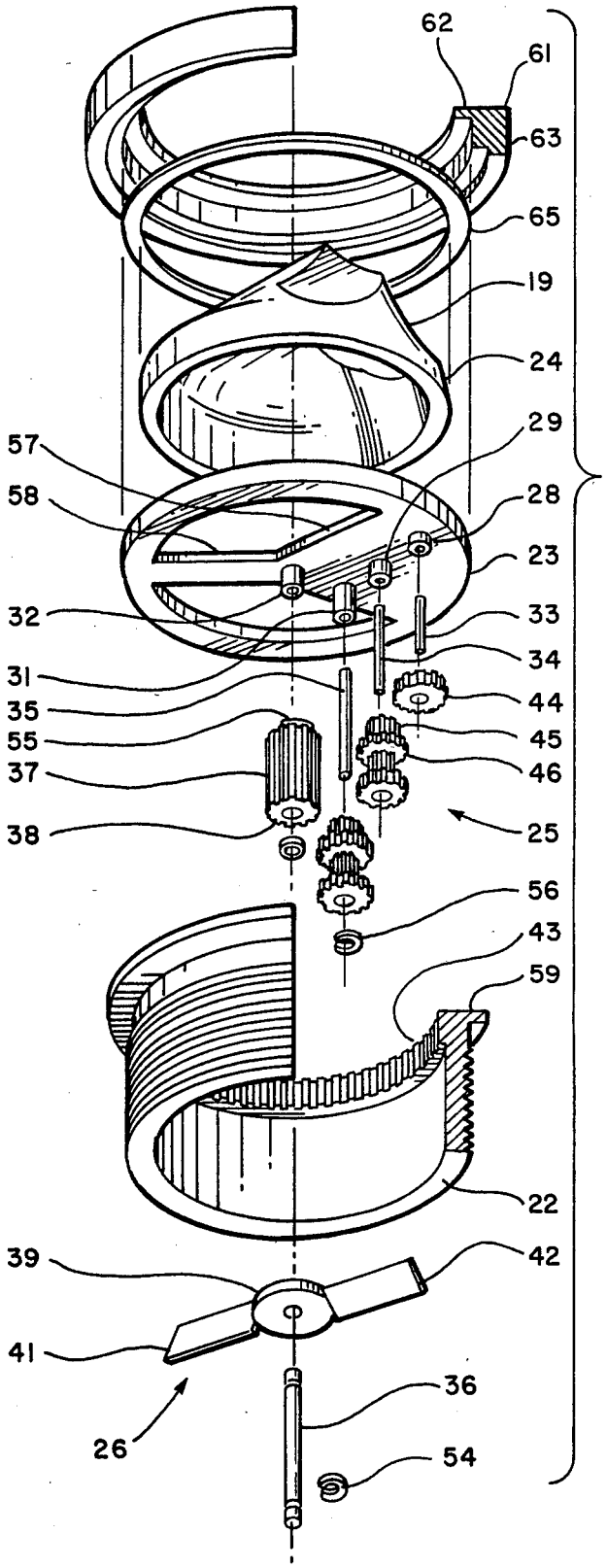
FIG. 4 is an exploded perspective view of the parts shown in the preceeding figures.
Figure 5:
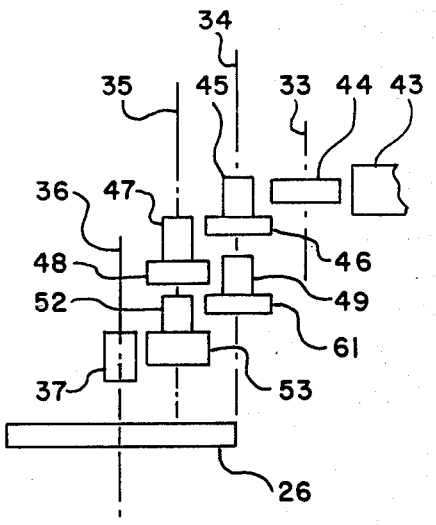
FIG. 5 is a diagrammatic developed view of the gear train of the invention.

The gear train 25 is shown in developed diagrammatic form in FIG. 5 and this figure should be considered in connection with FIG. 4 in the description of the gear train.

Gear 46 meshes with a gear 47 attached to and forming a unit with gear 48, the two gears 47 and 48 being mounted on shaft 35 received in the opening in boss 31. The gear 48 meshes with a gear 49 attached to and forming part of a gear 51, the gears 49 and 51 being mounted on shaft 34. Gear 51 meshes with a gear 52 which forms part of and is attached to a gear 53, the gears 52 and 53 being mounted on shaft 35. Gear 53 meshes with a gear 37 which as already stated is mounted on shaft 36 and is attached to the impeller 26.

Thus, as may be seen when comparing FIGS. 5 and 4, when the impeller 26 rotates under the influence of water moving thereby, through the various gears of the gear train illustrated, the gear 44, engaging with the ring gear 43 causes the assembled mechanism including the support ring 23 to rotate. A clamp ring 54 is disposed at the end of shaft 36 and holds the impeller 26 in position, a second clamp ring 55 or the like is disposed above the gear 37 to hold the gear and the attached impeller 26 from moving upwardly from beyond where it is supposed to be in relationship to the other gears. Attached to the end of shaft 35 is a clamp ring 56 holding the gear 53 in position and thus the other gears on shaft 35. It will be noted that the dimensions of the various other gears on shaft 33 and 34 are such that these gears will be held in position on their shafts without any further clamp rings, or the like. It will be understood, of course, that other well-known means for holding the gears to the shafts on which they are disposed may be used without departing from the scope of the invention. The step-down gear ratio of the gear train 25 from the impeller 26 to the ring gear 43 may be very large so that relatively high rotational velocities of the impeller 26 will be reduced to relatively slow automatic, continuous rotational movements of the therapy head nozzle 24. Two sets of gears on each of the shafts 34 and 35, of course, assist in the development of the desired gear ratio.

The impeller 26, the various gears 44–53 may all be of lightweight synthetic materials and thereby keep the weight of the unit to a low level.

The bosses 28, 29, 31 and 32 may, in effect, be formed on a web 57 from the center of which there extends a reinforcing or strengthening web 58. The webs 57 and 58 form the interior part of the ring 23, the rim of which is bonded to the nozzle head 24 at the juncture 27 as already described. The spaces between the webs 57 and 58 of the ring 23 form openings through which the water flows in passing from the inlet of the therapy head to the outlet or discharge opening 19.

When the impeller 26 rotates and causes the various gears of the gear train to rotate, ultimately the gear 44 is caused to rotate and since this gear meshes with the teeth of the ring gear 43 the whole mechanism supporting the gear train is caused to rotate as will be understood.

The ring 23 supporting the gear train and impeller and the nozzle head is disposed atop the surface 59 as may be seen best in FIG. 2 and a flange ring 61 is disposed so as to hold the assemblage together. The circular flange 62 extending inwardly from the rim 63 of flange ring 61 serves to hold the rim of the ring 23 in position as may be visualized in FIG. 2. An interior circular surface 64 of the rim 63 is bonded or otherwise sealed to the periphery of the circular surface 59. In this manner the rotating nozzle 24, the ring 23, the flange ring 61 and the body 22 are held together as a unitary structure.

Water flowing inwardly as shown by the arrow A in FIG. 2 passes by the vanes of the impeller 26, and passes through the openings 60 defined by the webs 57 and 58 and emerges through the nozzle opening 19 and in the process, the nozzle 24 including the opening 19 rotate at a predetermined rate. Disposed between the underside of the flange ring 62 and the upper surface of the adjacent rim or periphery of the ring 23 there is a friction reducing ring 65 which may be formed of the synthetic material known as Teflon. The Teflon ring or gasket 65 being of a very low frictional nature enables the head 24 to rotate even though the water moving through the therapy heads causes the rotating head 24 to bear against the undersurface of the flange ring 62.

The fit between the periphery of support ring 23, the associated surfaces of the flange ring 61 and the adjacent surface 59 of the body 22 may be relatively loose so that the rotating nozzle 23 can easily rotate. If some slight leakage occurs of the water flowing through the nozzle around the periphery of the support ring 23 and out past the rotating nozzle 24, thereby by-passing the jet stream through openings 19, this is relatively unimportant because only a small amount of water will so by-pass. The Teflon ring provides a seal preventing any substantial leakage or by-passing while still providing anti-friction. Other synthetic, or friction reducing materials may be used. Similarly mechanical, e.g., roller bearings may be used, but some by-passing would need to be tolerable or a further solution found.

Reference should now be had to FIGS. 6–9 inclusive which show a modified form of the invention having certain advantages. To the extent possible the same reference characters will be used for FIGS. 6–9 inclusive as were used for the preceeding figures, in some instances using suffix letters to identify slightly different parts.

Figure 6:
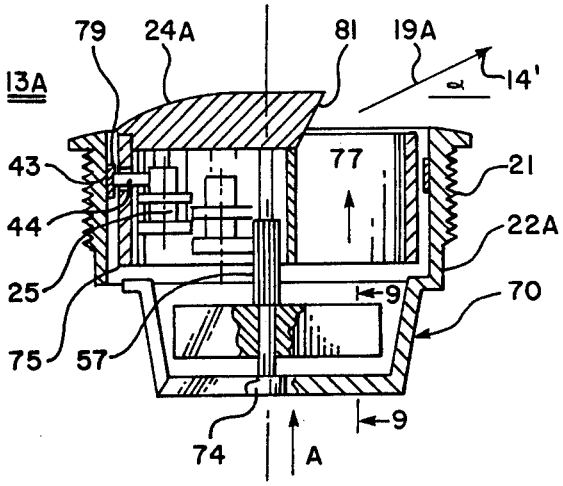
FIG. 6 is a sectional view of a modified form of the hydrotherapy head according to the invention.
Figure 8:
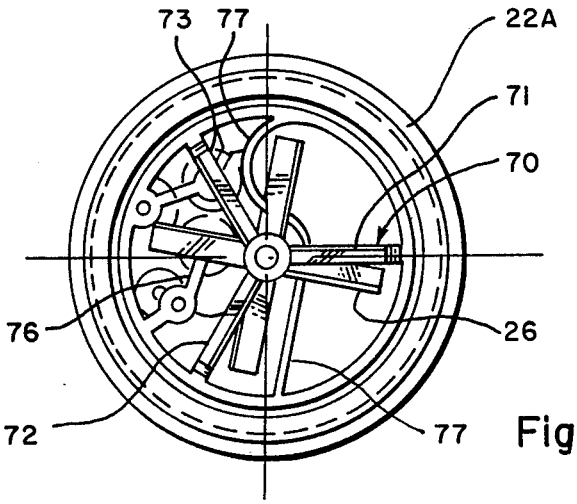
FIG. 8 is a bottom plan view, somewhat diagrammatic, of the head shown in FIG. 6.

Thus in FIG. 6 the hydrotherapy nozzle 13A is shown in sectional view and includes a body, or housing, 22A including threads 21 for receiving it in the conduit 14. Similarly to the structures of the preceeding figures, water enters according to the direction of arrow A and exits through the nozzle opening 19A as shown by the arrow A′ whose direction is that of an acute angle to the surrounding surfaces or to the original direction of water flow. Thus the water flowing out according to the arrow A′ exits at an acute angle, as described.

Figure 9:
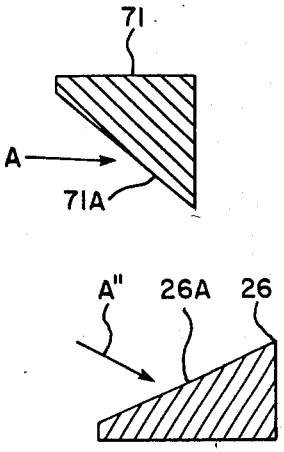
FIG. 9 is a sectional view, on an enlarged scale, taken in the direction of arrows 9—9 of FIG. 6.

Across the lower portion of the housing 22A there is a spider framework 70 having three legs 71, 72 and 73 which come together and join to a central hub 74 and may be an integral part of the lower edge of housing 22A. Such a configuration may conveniently be formed by a molding process. The central hub 74 also forms a bearing for the shaft 36. Attached to the shaft 36 in the same manner in connection to the preceeding figures is the impeller 26 having, as shown, four blades. The blades 71, 72 and 73 are essentially triangular in shape as may be seen best in FIG. 9. However, the end adjacent the direction of water flow is truncated as shown for ease in manufacturing these parts and for increased strength. The blades of the impeller 26 are also essentially triangular in form as shown in FIG. 9 with the angular surface 26A facing toward the direction of water A as represented by the arrow A″. The direction A″ represents the direction of the water flow of arrow A after impingment upon the angular surface 71A of the spider legs 71, 72 and 73.

Forming the legs upon which water impinges, as shown, by the angular surface 71A, causes the direction of the water to be altered to better impinge upon the angular surfaces 26A. This effects rotation of the impeller in a better and more reliable fashion.

The dome nozzle 24 of FIG. 2 has been reduced in profile to that shown by the reference character 24A of FIG. 6. The dome 24A extends around the periphery of the exit of the nozzle substantially, perhaps more than half-way, as may be visualized best in FIG. 7. This defines the nozzle opening 19A as shown in this figure. The nozzle dome 24A may be welded to, so to speak, a cylindrical member 75 which together with the dome nozzle 24A forms the nozzle member and a supporting base for holding the gear train 25 similarly to that shown in the preceeding figures.

Figure 7:
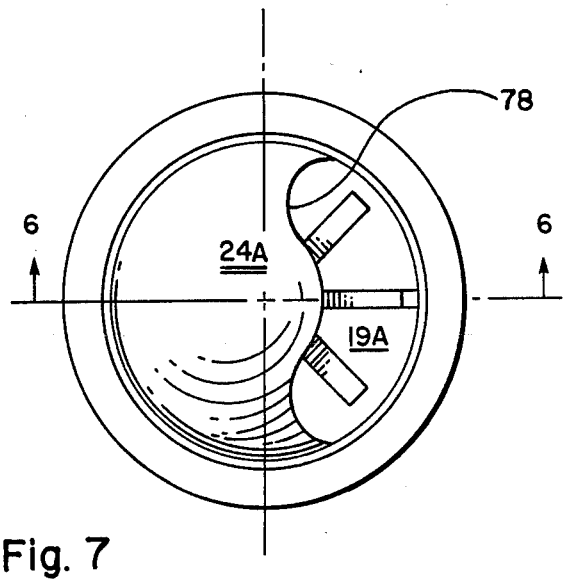
FIG. 7 is a top plan view, somewhat diagrammatic, of the head shown in FIG. 6.

The gear train includes a gear 44 which meshes with a ring gear 43 formed on the inside of the housing 21. The gear 44 through the various gears of gear train 25 engages a gear 57 on the shaft 36 all as similar to the preceeding figures. The various gears, shafts and the shaft 36 are supported at their ends in suitable supporting arms as shown by the arm 76 in FIG. 8. Similar supporting members, not shown, are provided at the other ends of the shaft which are adjacent the bottom surface of the dome nozzle 24A in FIG. 6. If desired, the gear members may be in a separate compartment defined by a wall 77 which may or may not be present, as desired, the upper end of the wall 77 being attached as by integral casting with the upper edge of the cylindrical member 75. Referring to FIG. 7 the cylindrical wall may follow the outline 78 of the nozzle opening 19A. Thus as may be visualized in FIG. 6, the shaft 36 is supported at its lower end in the hub 74 and at its upper end in a supporting spider network at the upper end of the cylindrical member 75 which is at the bottom of the dome nozzle member 24A.

The dome nozzle 24A is made of low profile in order to avoid having this member project too far into the spa, for example, and thus become something upon which the bather may bump into or have his bathing suit hang up on.

The wall of the cylindrical member 75 has an opening 79 in it through which the gear 44 projects in order to engage the ring gear 43.

It may be preferable in some structures to make the nozzle dome 24A virtually flat or planer with the surrounding surface of the spa.

Adjacent the nozzle exit 19A the dome nozzle 24A may have an angular surface 81 which may be termed the angular exit of the nozzle and assists in achieving the water direction of A' at the acute angle alpha as desired.

When it is desired to remove the therapy head it is only necessary for the service man, for example, to grasp the flange ring 63 and turn the head in the appropriate direction whereby, by means of the threads 21, the therapy head is screwed out. A second head may, of course, immediately replace the one removed without having the spa inoperative for anything other than a very short interval.

Figure 10:
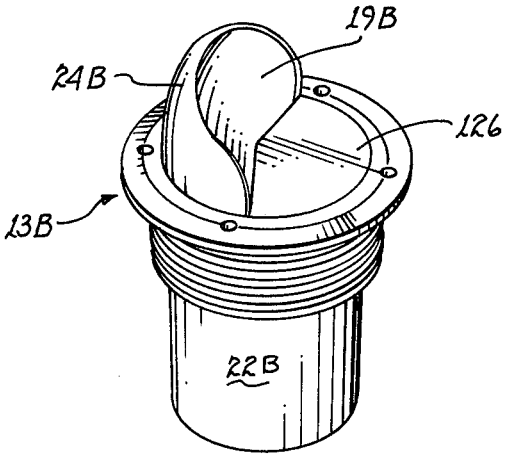
FIG. 10 is a perspective view of a further modification of a therapy head according to the invention.
Figure 11:
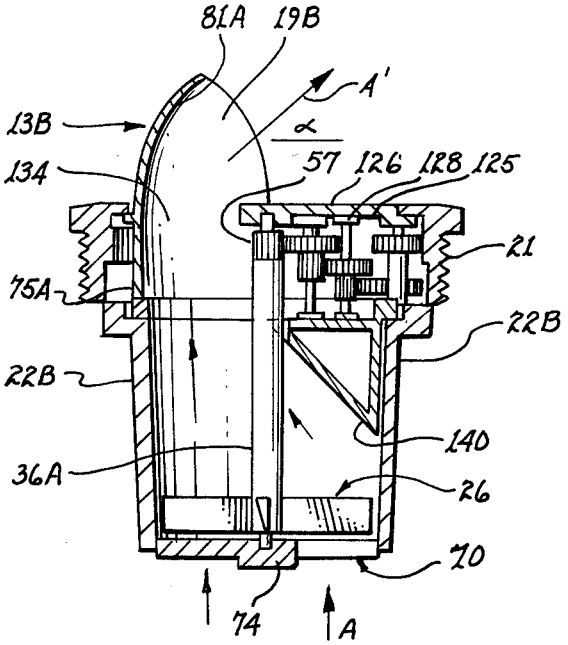
FIG. 11 is a sectional view of the head shown in FIG. 10.
Figure 12:
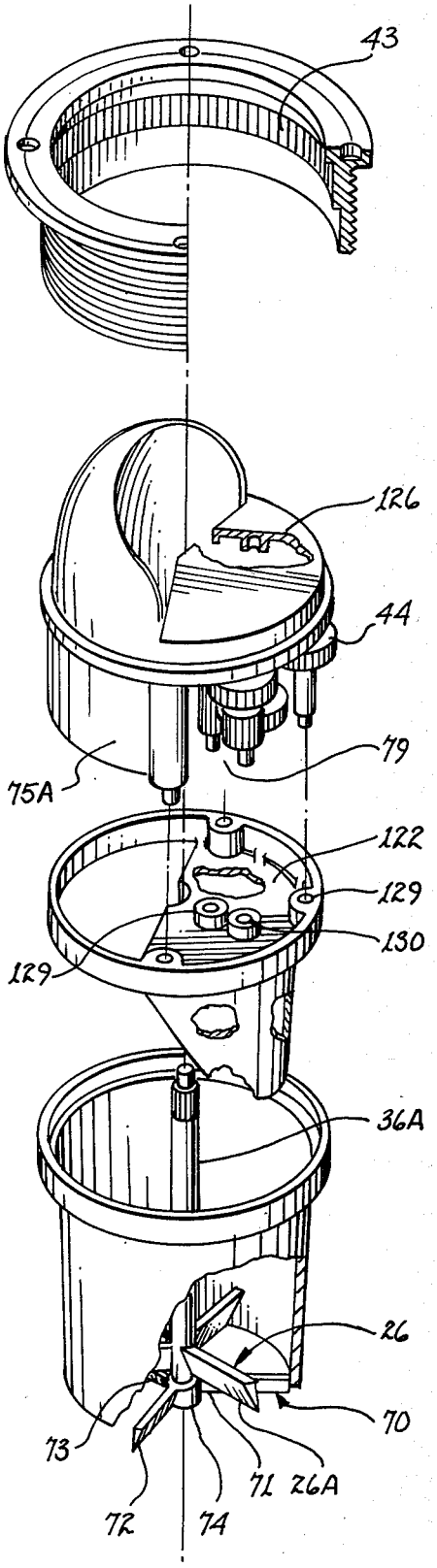
FIG. 12 is an exploded perspective view, partially in section and partially broken away of the head shown in FIGS. 10 and 11.

FIGS. 10–12 inclusive show a modified and presently preferred form of the invention having certain advantages. To the extent possible the same reference characters will be used for FIGS. 10–12 inclusive as were used for the preceeding figures, in some instances using suffix letters to identify slightly different parts.

Thus, in FIG. 11 the hydrotherapy nozzle 13B is shown in sectional view and includes a body, or housing, 22B including threads 21 for receiving it in the conduit 14. Water enters the housing 22B according in the direction of arrow A and exits through the nozzle opening 19B as shown by the arrow A' whose direction is that of an acute angle to the surrounding surfaces or to the original direction of water flow. Thus the water flowing out according to the arrow A' exits at an acute angle, as described.

Across the lower portion of the housing 22B there is a spider framework 70 having three legs 71, 72 and 73 which come together and join to a central hub 74. Such a configuration may conveniently be formed by a molding process, may be an integral part of the lower edge of housing 22A. The central hub 74 also forms a bearing for the shaft 36A. Attached to the shaft 36A in the same manner as in the preceding figures is the impeller 26 having, as shown, four blades.

The blades 71, 72 and 73 are essentially triangular in shape as may be seen best in FIG. 9. However, the end adjacent the direction of water flow is truncated, as shown, for ease in manufacturing these parts and for increased strength.

The blades of the impeller 26 are also essentially triangular in form as shown in FIG. 9 with the angular surface 26A facing toward the direction of water A as represented by the arrow A". The direction A" represents the direction of the water flow of arrow A after impingment upon the angular surface 71A of the spider legs 71, 72 and 73. Forming the legs upon which water impringes with an angular surface 71A causes the direction of the water to be altered to better impinge upon the angular surfaces 26A. This effects rotation of the impeller in a better and more reliable fashion.

The dome nozzle 24 of FIG. 2 has been opened in profile to that shown by the reference character 24B of FIG. 10. The dome 24B extends around the periphery of the exit of the nozzle substantially, perhaps more than half-way. This defines the nozzle opening 19B as shown in this figure. The nozzle dome 24B may be welded to, or integral with, a hollow cylindrical member 75A which together with the upper land 126 and lower land 122 forms the nozzle member and a supporting base for holding the gear train 25.

Referring to FIG. 12, the gear train includes a gear 44 which meshes with a ring gear 43 formed on the inside of the housing 22B. The gear 44 through the various gears of gear train 25 engage a gear 57 on the shaft 36A, similar to the preceding figures. The various gears, shafts and the shaft 36A are supported at their ends in suitable bosses and indentations on lower land 122 as shown in FIGS. 11 and 12. Similar supporting members are provided at the other ends of the shafts which are on the bottom surface 125 of upper land 126 per FIG. 11. Thus, as may be visualized in FIG. 11, the shaft 36A is supported at its lower end in the hub 74 and at its upper end in a boss on the lower surface 125 of upper land 126.

The wall of the cylindrical member 75A has an opening 79 in it through which the gear 44 projects in order to engage the ring gear 43.

Adjacent the nozzle exit 19B the dome nozzle 24B may have an angular surface 81A which may be called the angular exit of the nozzle and which assists in achieving the water direction of A' at the acute angle alpha as desired.

When it is desired to remove the therapy head it is only necessary for the service man, for example, to grasp the flange ring 63 and turn the head in the appropriate direction whereby, by means of the threads 21, the therapy head is screwed out. A second head may, of course, immediately replace the one removed without having the spa inoperative for anything other than a very short interval.

In the embodiment of the rotatable therapy head shown in FIGS. 10–12 other improvements have been made which include (1) lengthening the body 22B to make room for, and providing a stream flow diversion means—here an angular baffle, or shield, 123 (which is hollow to save weight and materials) depending from lower land 122 and which compresses and guides the stream into channel 134 past gear train 25; and (2) lengthening the impeller shaft 36A to extend past shield 123 to thereby dispose impeller blades 26 at the upstream end of body 22B, spaced from gear train 25.

This combination of shield and impeller placement minimizes stream turbulence and eliminates a flutter that is sometimes detectable in the stream output of less preferred embodiments. Also, pressure drop is lessened and no auxiliary device for forcing entrained air through the system, such as a motor driven fan, is required.

In this embodiment a semicircular channel 149 is provided in the shield to receive a section of the impeller shaft 36A which assists in stabilizing the longer shaft which is supported by hub 74. The gear train is securely held in place of the presence of suitable bosses 128 and 129 and indentations 130 for the journalling of of the shafts of the individual gears of the gear train 125 between the upper land 126 and the lower land 122. In the configuration of this embodiment, the nozzle presents a more open and vertical profile also tending to lessen turbulence in the stream. An additional advantage is that the shield's angularly disposed surface 140 deflects sediment in the water from the gear train which protects the gears from jamming.

Additionally, a therapy head as described may be constructed wherein there is a drive means operably connected to the nozzle or its base and which is adapted to rotate the nozzle and the means may include one or more vanes adapted to rotate the nozzle responsive to the flow of water through the housing, either with or without a gear reduction means or train.

A very simple, lightweight, easily serviceable, and efficient therapy head has been achieved as described. The various parts of the therapy head may be formed of synthetic material such for example, nylon, and the parts may be injection molded to the fullest extent desired thereby achieving a further efficiency and lightweight.

I claim:

1. A hydrotherapeutic system including in combination:

a container for fluid having a size sufficient to permit at least partial submersion of a person therein;

a plurality of hydrotherapy heads in said container located beneath the normal fluid level thereof for supplying streams of fluid under pressure at an acute angle to the surface of the container at the location of each of said heads; and rotating means comprising an impeller and gear train mechanism rotated by the fluid flowing through each of said heads for rotating each head independently of the others to thereby automatically, simultaneously and continuously rotate the streams of fluid issuing from said heads to create a varying pattern of fluid movement in said container.

2. A hydrotherapeutic system including in combination:

a container for fluid having a sufficient size to permit at least partial submersion of a person therein;

at least one hydrotherapy head in said container located beneath the normal fluid level thereof for supplying a stream of fluid under pressure at an acute angle to the surface of the container at the location of said at least one hydrotheraphy head; and means located within said head and responsive to said stream of fluid passing through said head for automatically and continuously rotating the stream of fluid issuing from said head to create a varying pattern of fluid movement in said container.

3. A hydrotherapeutic system including in combination:

a container for fluid having a size sufficient to permit at least partial submersion of a person therein;

a plurality of hydrotherapy heads in said container located beneath the normal fluid level thereof for supplying streams of fluid under pressure at an acute angle to the surface of the container at the location of each of said heads; and means for independently rotating each of said heads for automatically, simultaneously and continuously rotating the streams of fluid issuing from said heads to create a varying pattern of fluid movement in said container.

4. The combination according to claim 3 wherein said rotating means comprises an impeller and gear train mechanism rotated by the fluid flowing through said head for rotating each head independently of the others.

5. The combination according to claim 4 wherein each of said plurality of hydrotherapy heads supplies a mixture of water and air under pressure, and streams of water and air issue from each of said heads to create said varying pattern of water and air movement in said container.

6. A hydrotherapeutic system including in combination:

a container for fluid having a size sufficient to permit at lease partial submersion of a person therein;

a plurality of hydrotherapy heads in said contianer located beneath the normal fluid level thereof for supplying streams of fluid under pressure at an acute angle to the surface of the container at the location of each of said heads, each of said plurality of hydrotherapy heads supplying a mixture of water and air under pressure; and means for automatically simultaneously and continuously rotating the streams of water and air issuing from each of said heads to create a varying pattern of water and air movement in said container.

* * * * *